US005433164A

United States Patent [19]

Sneath

[11] Patent Number: 5,433,164

[45] Date of Patent: Jul. 18, 1995

[54] SUBMERSIBLE VESSEL

[76] Inventor: Andrew J. S. Sneath, 55 Monument Lane, Rednal Birmingham B459QQ, United Kingdom

[21] Appl. No.: 215,902

[22] Filed: Mar. 22, 1994

Related U.S. Application Data

[63] Continuation-in-part of Ser. No. 97,464, Jul. 26, 1993, abandoned.

[51] Int. Cl.[6] ..... B63C 11/46

[52] U.S. Cl. ..... 114/315

[58] Field of Search ..... 114/312, 315

[56] References Cited

U.S. PATENT DOCUMENTS

| | | | |
|---|---|---|---|
| 2,784,559 | 3/1957 | Kajmo . | |
| 3,255,723 | 6/1966 | Teetor . | |
| 3,344,614 | 10/1967 | Byck . | |
| 3,387,580 | 6/1968 | Walker . | |
| 3,416,478 | 12/1968 | Markham | 114/315 |
| 3,420,202 | 1/1969 | Oversmith . | |
| 3,757,721 | 9/1973 | Ohishi | 114/315 |
| 3,890,920 | 6/1975 | Buelk . | |
| 4,189,019 | 2/1980 | Zech | 180/182 |
| 4,276,851 | 7/1981 | Coleman | 114/313 |
| 4,288,176 | 9/1981 | Devine | 405/188 |
| 4,348,976 | 9/1982 | Gilbert | 114/270 |
| 4,813,367 | 3/1989 | Stevenson | 114/315 |
| 4,843,996 | 7/1989 | Parker | 114/315 |
| 4,889,066 | 12/1989 | Neil et al. | 114/312 |

FOREIGN PATENT DOCUMENTS

| | | |
|---|---|---|
| 1148743 | 12/1957 | France . |
| 2577511 | 8/1986 | France . |

OTHER PUBLICATIONS

Article entitled Delta-"Wing" Submarine Is Semi-Dry, *Machine Design* magazine, 1969.

*Primary Examiner*—Jesus D. Sotelo
*Attorney, Agent, or Firm*—Quarles & Brady

[57] ABSTRACT

An underwater apparatus includes a seat portion and a pedestal extending from the front of the seat portion. A helmet is attached to the remote end of the pedestal and forms a compartment with an opening toward the seat portion. At least a part of the helmet is transparent. A tank of compressed air is attached to the apparatus and supplies air to the compartment. A diver straddles the seat portion and the diver's head extends through the opening into the compartment in order to breath air therein. In the preferred embodiment, a motorized propulsion system is operatively coupled to either the seat portion or the helmet for propelling the vessel underwater.

23 Claims, 7 Drawing Sheets

FIG. 9
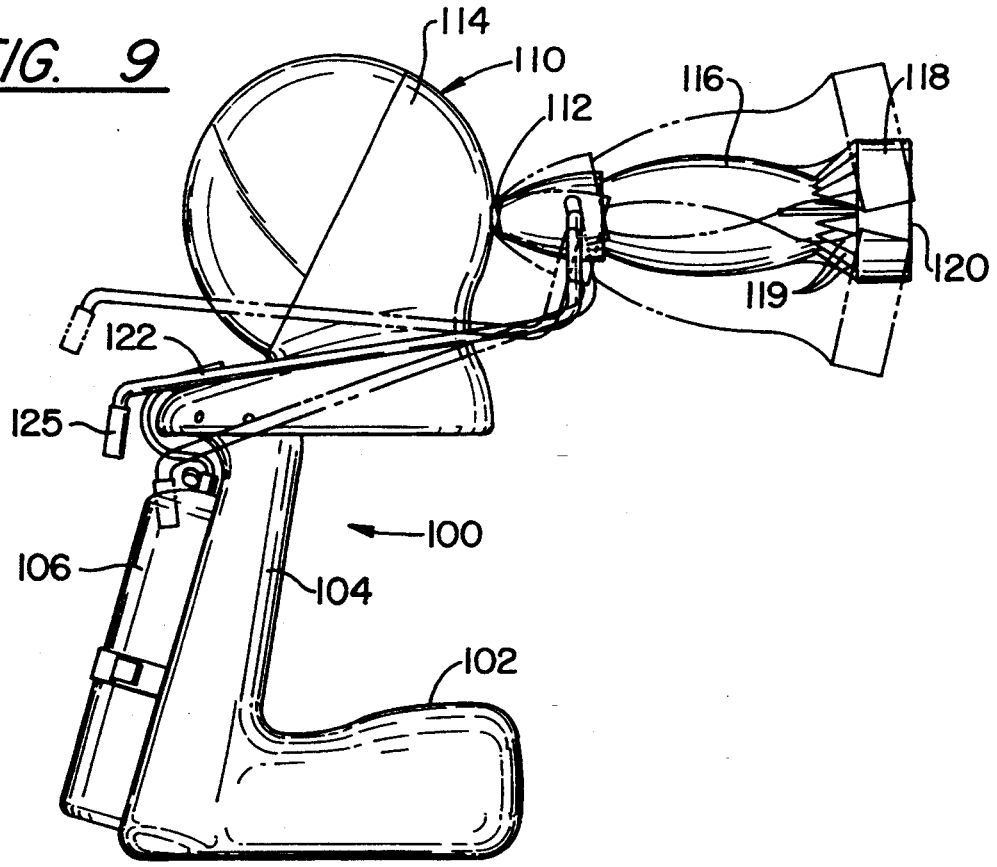
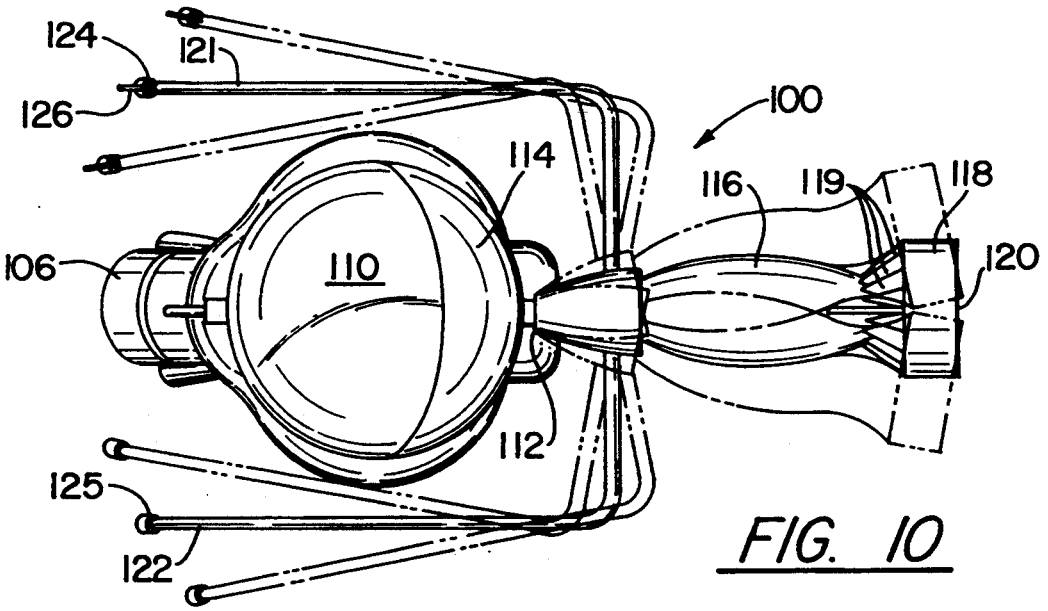
FIG. 10

SUBMERSIBLE VESSEL

This is a continuation-in-part application of U.S. patent application Ser. No. 08/097,464, filed on Jul. 26, 1993, now abandoned.

BACKGROUND OF THE INVENTION

This present invention relates to submersible vessels, and more particularly to such vessels for use in transporting preferably one person.

A known type of submersible vessel comprises a sealed chamber which houses one or more occupants. The occupants enter the chamber via a hatch and can spend considerable lengths of time underwater. The vessel includes air tanks supplying air to the chamber for breathing as well as to buoyancy tanks which enable the vessel to dive and surface. Motors drive propellers that enable the vessel to be maneuvered underwater. An example of a submersible vessel of this type is shown in U.S. Pat. No. 4,889,066.

Another type of submersible vessel is arranged to form a bubble of air at the same pressure as the surrounding water. Divers can enter and leave the vessel underwater via a hatch or an open bottom. U.S. Pat. No. 3,255,723 discloses a vessel of this type.

These known vessels are large and heavy and expensive to operate. In addition, previous submersible vessels are relatively awkward to maneuver and restrict the user's access to underwater objects.

SUMMARY OF THE INVENTION

A submersible vessel has been developed which alleviates the problems mentioned above.

In accordance with this invention as seen from a first aspect there is provided a submersible vessel comprising a body portion and a seat portion, the body portion being arranged to contain a volume of air above the seat portion when the vessel is submerged so that at least the user's head can project out of the water into said volume of air thereby enabling the user to breath.

Preferably ballast weights are provided in the seat portion so that the vessel remains upright in the water and has relatively neutral buoyancy.

The volume of air is replenished from a compressed air cylinder which may be mounted in the seat portion, the user sitting astride the cylinder, or mounted to the exterior of the vessel.

The vessel may be propelled by a motor which is driven by compressed air or electricity from a battery. Alternatively, the vessel may have no motor (or a motor may be de-energized) and the user may "walk" along the sea or river bed whilst remaining astride the seat.

It will be appreciated that the compressed air driven vessel will consume a considerable amount of air when in use. Thus in accordance with this invention as seen from a second aspect there is provided a submersible vessel comprising a pneumatic motor having an exhaust outlet arranged to supply breathing air for a user of the vessel. The pneumatic motor is of an oil-less type so that it does not pass any fumes to the exhaust outlet. Preferably a supply passage is provided through which air from a compressed air tank flows to the user's compartment when the motor is not running.

BRIEF DESCRIPTION OF THE DRAWINGS

FIG. 9 is a side view of a fourth embodiment of a submersible vessel;

FIG. 10 is a top view of the fourth embodiment; and

DETAILED DESCRIPTION OF THE INVENTION

As used in this document, including the claims hereof, the term "vessel" means a structure designed for navigation in or on water.

Figure 1:
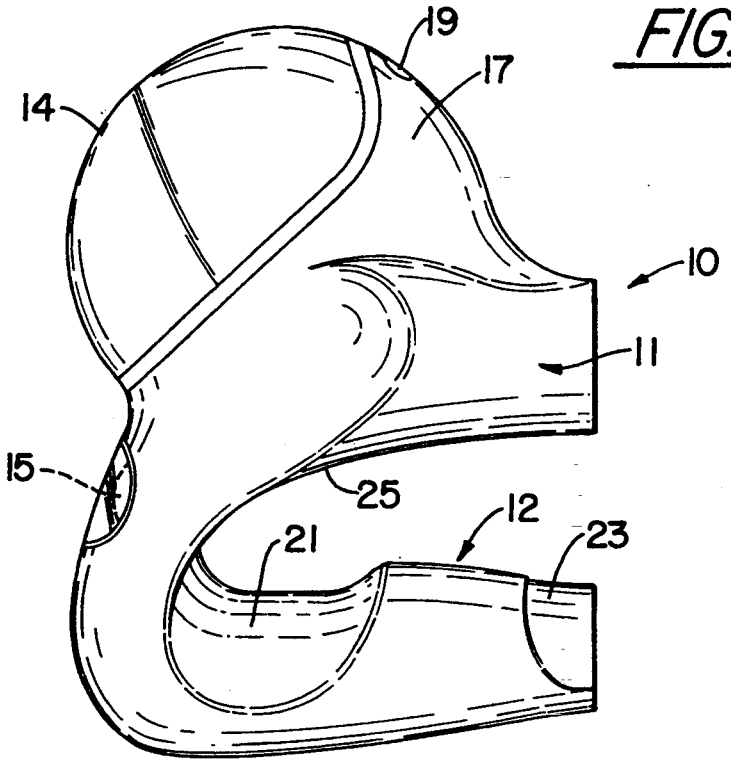
FIG. 1 is a side view of a submersible vessel in accordance with this invention.
Figure 2:
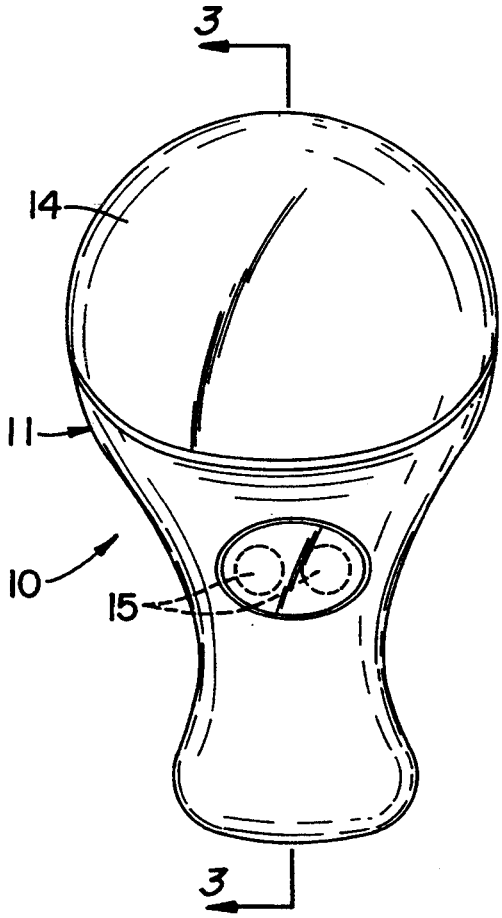
FIG. 2 is a front view of the submersible vessel of FIG. 1.
Figure 3:
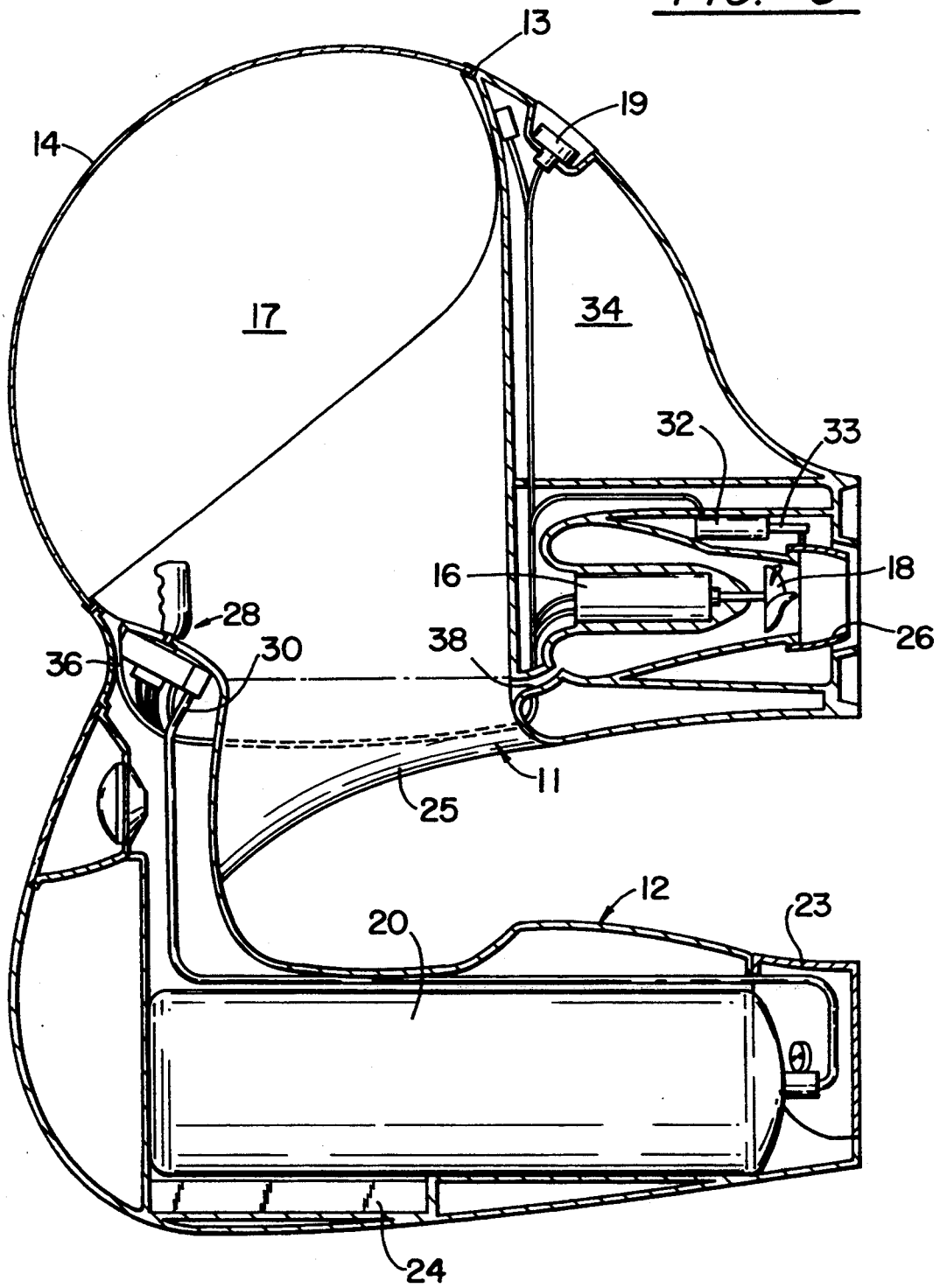
FIG. 3 is a sectional view along line 3—3 of FIG. 2.

Referring to FIGS. 1–3, a submersible vessel 10 comprises a body portion 11 that is contiguous with and extends above a seat portion 12. A user straddles the seat portion which has a curved recess 21 to accommodate the user's legs while sitting on surface 22. Grab handles may be provided on the vessel 10 and a lifting point 19 is preferably formed on the top of the body portion 11. Headlights 15 are provided at the front of the vessel near where the body and seat portions 11 and 12 meet.

The body portion 12 is joined to the front region of the seat portion 11 and forms a sealed dome-shaped compartment 17 having an open bottom 25. The compartment 17 comprises a window 14 which is sealed in an opening in the front of the body by a water-tight seal 13. When the vessel 10 is submersed in water, a bubble of air is trapped inside the compartment 17 and a user sitting on the seat portion 12 has his or her head and shoulders projecting into the compartment 17 to breath the trapped air.

The vessel 10 is powered by a compressed air motor 16 which drives a propeller 18. Compressed air is supplied to the motor 16 from a tank 20 mounted inside the seat portion 12. The exhaust air from the motor 16 flows through tube 36 to refresh the air inside the compartment 17, which reduces the overall air consumption of the vessel. A door 23 is provided on the seat portion 12 to allow the tank 20 to be removed and to give access to a ballast weight 24 mounted below the tank. The ballast weight 24 weighs approximately the same as the quantity of water displaced by the trapped air in compartment 17 and is removable so that the vessel 10 can be transported easily when it is out of the water.

A movable nozzle 26 is mounted behind the propeller 18 so that the vessel 10 can be steered. Controls 28 for motor speed and direction are mounted in front of the compartment 17 inside body 11. The controls 28 direct a supply of compressed air from the tank 20 through a plurality of tubes 30 to the pneumatic motor 16 and to an actuator 32. The actuator is coupled by linkage 33 to pivot the nozzle 26 and thereby steer the forward movement of the vessel 10.

As mentioned previously, if the motor 16 is switched off the user can "walk" along the sea or river bed while remaining astride the seat. A modified vessel may have no motor at all, being propelled solely by the user.

A buoyancy bag or cavity 34 is housed inside the body 10 behind the user compartment 17 and can be inflated with air from tank 20 to cause the vessel 10 to rise to the surface of the water.

Air is fed into the compartment 17 from motor 16 through an inlet 36 and an outlet 38 is provided so that excess air can be expelled to maintain a constant air volume. A control may be provided so that the trapped air can be rapidly flushed from the compartment 17. Further controls 28 can be incorporated for surfacing in an emergency or for surfacing at a controlled rate for decompression purposes. Automatic controls may be provided for surfacing when the air supply is low, surfacing on recall and for halting dives below a predetermined depth.

Figure 4:
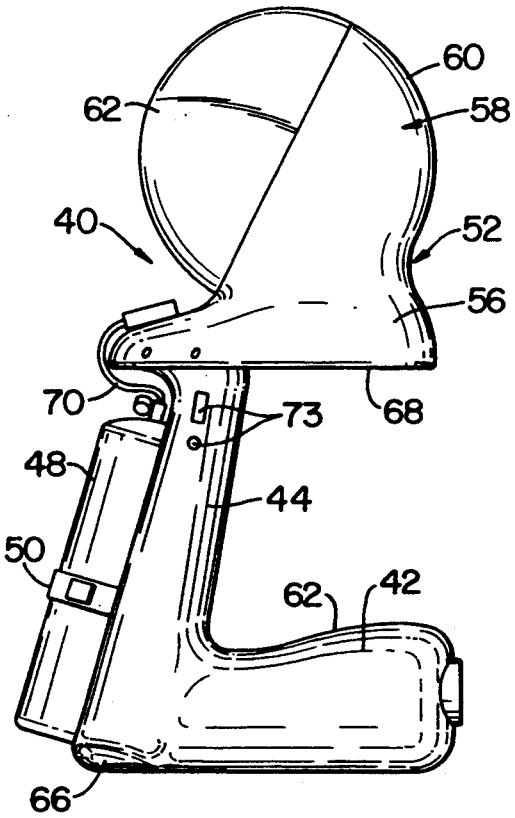
FIG. 4 is a side view of a second embodiment of a submersible vessel.
Figure 5:
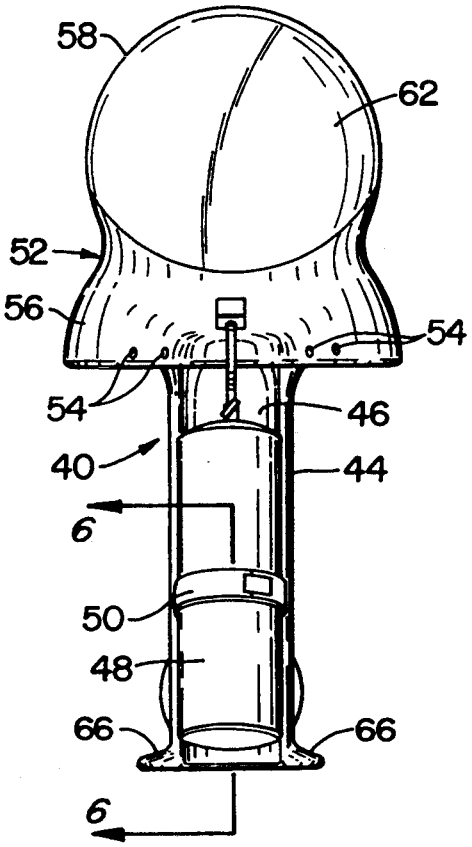
FIG. 5 is a front view of the second embodiment.
Figure 6:
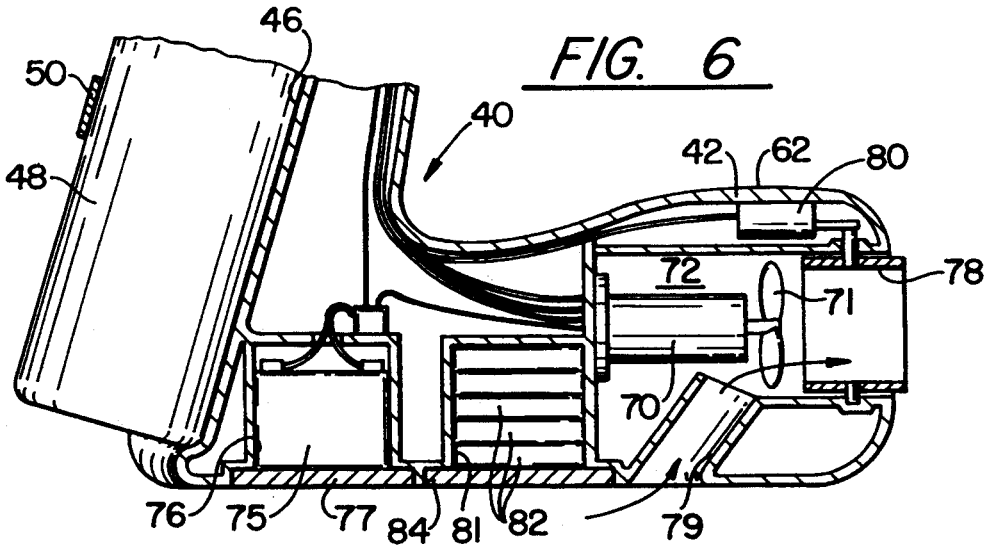
FIG. 6 is a sectional view along line 6—6 of FIG. 5.

With reference to FIGS. 4, 5, and 6, a second version of a submersible vessel 40 has a housing that includes a generally cylindrical seat portion 42 with a pedestal 44 extending upwardly from the front region of the seat portion. Pedestal 44 has an elongated concave front surface 46 within which is received a compressed air tank 48, such as commonly used in underwater diving. A strap 50 holds the tank 48 in the concave recess 46.

A helmet 52 of the housing is attached by bolts 54 to the end of the pedestal 44 which is remote from the seat portion 42. The helmet 52 is hollow thereby forming the compartment for receiving the head and shoulders of a user of the vessel 44. The helmet 52 includes an annular skirt 56, which is fastened to the pedestal 44, and a dome 58 with a rear portion 60 that extends upward from and is contiguous with the skirt 56. The rear portion 60 of the dome 58 has a circular opening toward the front of the vessel 40. A hemispherical, transparent window 62 is sealed in a water-tight manner to the rear portion 60 at the perimeter of the circular opening.

The user straddles the seat portion 42 and is able to sit on the upper surface 64 with legs draped on both sides of the seat portion and partially around the pedestal 44. A separate foot rest 66 is provided on both sides of pedestal 44 at the front of the vehicle. In this position, the user's shoulders and head extend upward into the helmet 52 through the open bottom 68 and the user is able to see through the window 62. The compressed air tank 48 has a hose 70 connected to the helmet 52 to supply the interior of the helmet with air for the user to breath. The user's arms extend out from under the helmet 52 and can grasp the pedestal 44.

The seat portion 42 contains a mechanism for propelling the vessel 40 through the water. An electric motor 70, as is commonly used to power fishing boats during trolling, is attached inside a chamber 72 at the rear of the seat portion 42. The electric motor 70 drives a propeller 71 which draws water into the chamber 72 through an inlet passage 79 in the bottom of the vessel 40. The water then is propelled from the chamber 72 through an outlet nozzle 78 located in an opening at the rear of the seat portion 42. The nozzle 78 is pivoted laterally by an electrically powered actuator 80 to steer the vessel 40.

The motor 70 and actuator 80 are powered by a battery 75 located within a watertight cavity 76 in the bottom of the front region of the seat portion 42. The cavity 76 has an opening through the bottom of the vessel 40 which is sealed by a water-tight first hatch 77. Controls 71 on the upper portion of pedestal 44 turn on and off the electric motor 70 and control the actuator 80 to direct the nozzle 78.

Another cavity 81 in the bottom of the seat portion 42 houses a plurality of metal ballast plates 82 which counter the buoyancy of the vessel when the helmet 52 is filled with air and maintain the vessel upright. A second hatch 84 allows the ballast plates to be removed from the cavity for easy transport of the vessel 40 out of the water.

Figure 7:
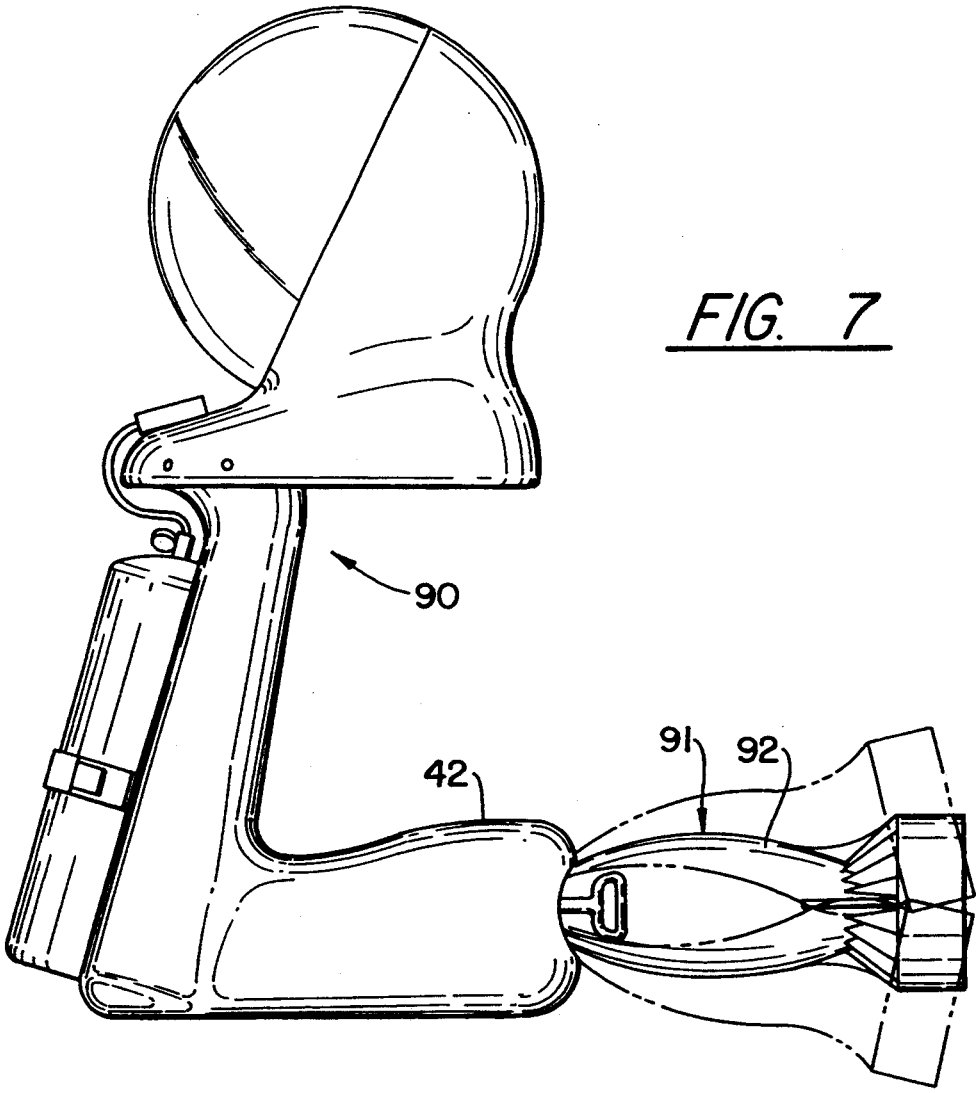
FIG. 7 is a side view of a third embodiment of a submersible vessel.
Figure 8:
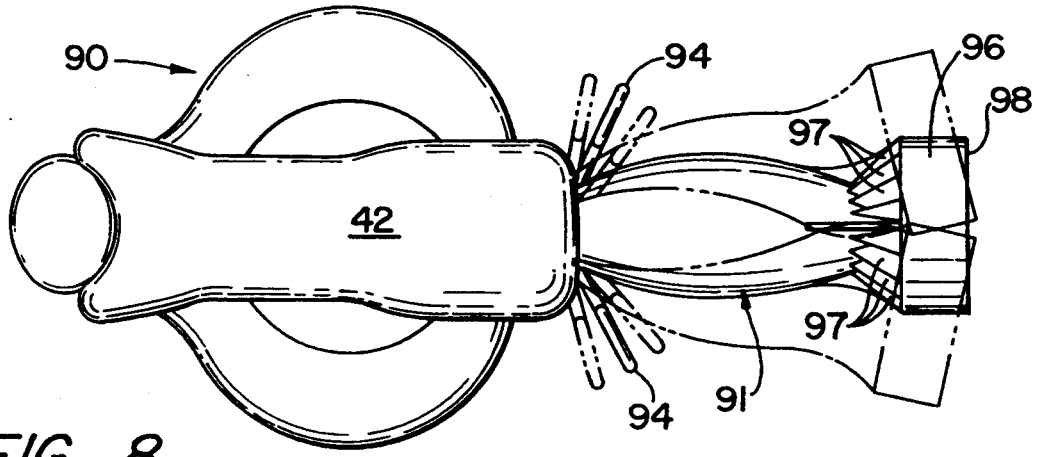
FIG. 8 is a bottom view of the third embodiment.

FIGS. 7 and 8 show a third version of a submersible vessel 90 which is a modification of the version 40 wherein the propulsion unit 91 is contained in a separate housing 92 pivotally attached to the rear of the seat portion 42. A universal joint is used to couple the propulsion housing 92 so that it may pivot in two axes with respect to the seat portion 42. Specifically the housing 92 can pivot up and down as shown in FIG. 7 or left and right with respect to the seat portion 42 as shown in FIG. 8. Alternatively, a simple pin coupling that allows only lateral movement of the propulsion unit 91 can be used.

The propulsion unit 91 can comprise an electric motor similar to that shown in FIG. 6 with a battery housed in the seat portion 42 and connected to the motor 70 by appropriate cables. A propeller is attached to the motor 70 within a rear tubular shield 96 of the propulsion unit 91 that has a plurality of water inlets 97 and an outlet 98. The submersible vessel 90 does not require a movable nozzle and actuator to direct the water flow. Instead, the outer housing 92 of the propulsion unit 91 has a pair of handles 94 on opposite sides which the user grasps to direct the orientation of the housing with respect to the seat portion 42. Movement of the propulsion unit 91 directs the flow of water at different angles with respect to the seat portion thereby steering the vessel 90 left and right, and up and down.

FIGS. 9 and 10 show a fourth embodiment of a submersible vessel 100 according to the present invention. This vessel 100 has a seat portion 102 with a pedestal 104 extending upwardly from the front of the seat portion. The pedestal 104 has a concave front surface within which is received a compressed air tank 106 held in place by a strap 106. A helmet 110 has a design similar to helmet 52 described with respect to FIG. 4 and is bolted to the top of pedestal 104. However helmet 110 has a universal joint coupling 112 centrally located on the rear of dome 114.

The connector 112 is used to attach a propulsion unit 116 similar to propulsion unit 92 in FIGS. 7 and 8. Specifically propulsion unit 116 includes an electric motor and a propeller located in a rear tubular shield 118. When driven, the propeller draws water into the shield 118 through inlets 119 and expels the water through outlet 120. Two handle bars 121 and 122 extend outwardly from opposite sides of the propulsion unit 116 and curve downward and forward around the helmet 110. The handle bars 121 and 122 terminate with grips 124 and 125 at the front of the vessel 100. The right grip 124 includes a lever 126 which controls the operation of the electric motor within the propulsion unit 116.

A user sitting astride the seat portion 102 with head and shoulders projecting upward into the helmet 110, is able to grasp the grips 124 and 125 with hands. The user manipulates the handle bars to pivot the propulsion unit 116 about the helmet to direct the water flow from the propeller to steer the vessel 100.

Figure 11:
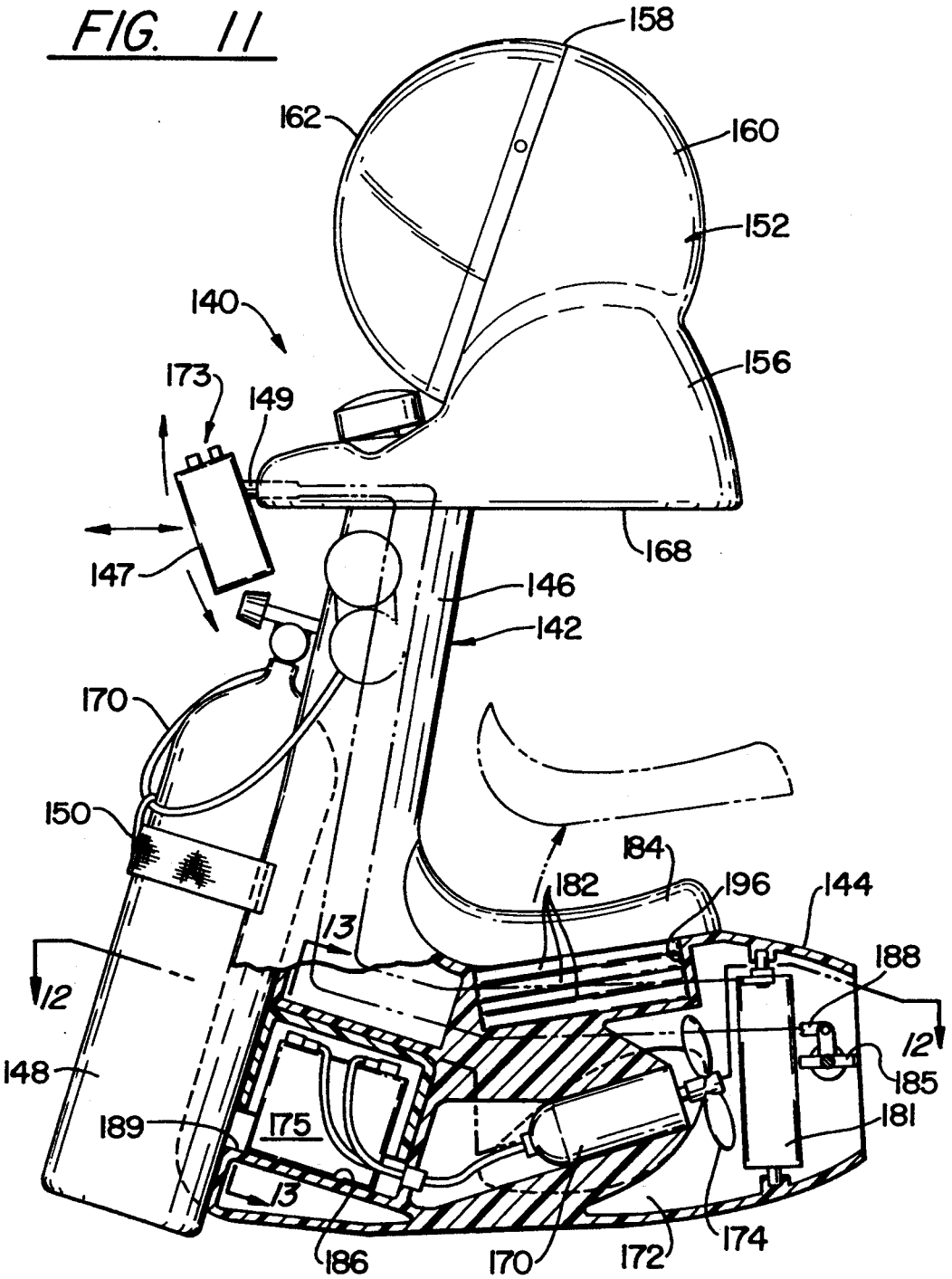
FIG. 11 is a partial cross sectional side view of a fifth embodiment of a submersible vessel.
Figure 12:
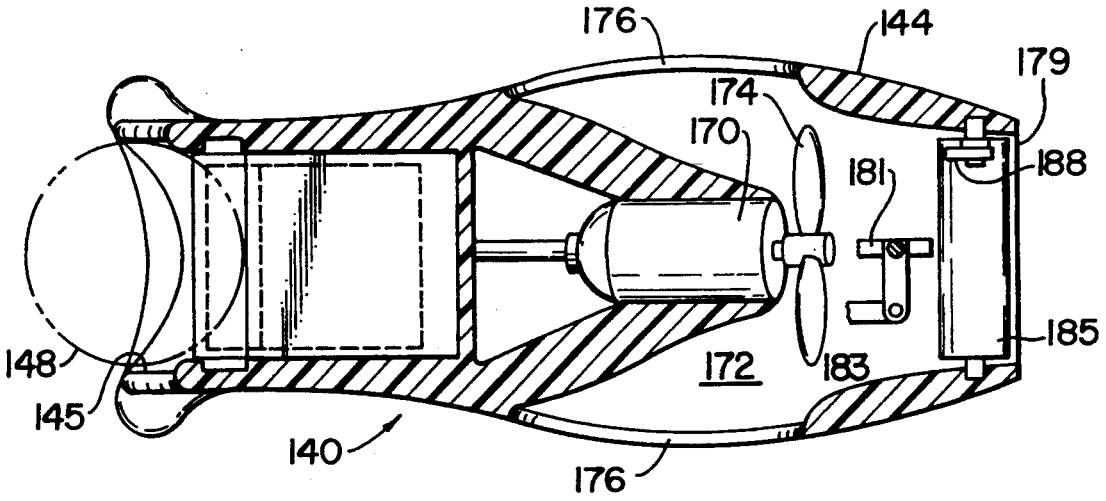
FIG. 12 is a cross section view along line 12—12 in FIG. 11.

Referring to FIGS. 11 and 12, a preferred embodiment of the submersible vessel 140 according to the present invention has a housing 142 that includes a generally cylindrical seat portion 144 with a pedestal 146 extending upwardly from the front of the seat portion. Pedestal 146 has an elongated concave front surface 145 within which is located a compressed air tank 148 held in place by a strap 150.

A helmet 152 of the housing 142 is attached to the remote end of the pedestal 146 and forms a compartment for the head and shoulders of a user of the vessel 140. The helmet 152 includes an annular skirt 156 which is fastened to the pedestal 146 and has a dome 158 with a rear portion 160 that extends upward from and is contiguous with the skirt 156. The rear portion 160 of the dome 158 has a circular opening toward the front of the vessel 140 and a hemispherical, transparent window 162 is sealed in a water-tight manner to the rear portion 160 at the perimeter of the circular opening.

The user straddles the seat portion 144 with the user's shoulders and head extending upward into the helmet 152 through the open bottom 168. A hose 170 from the compressed air tank 148 supplies the interior of the helmet with air for the user to breath. The user's arms extend out from under the helmet 152 and can grasp a rectangular steering member 147 on a shaft 149 which projects from the front of the skirt 156.

The seat portion 144 contains a propulsion unit with an electric motor 170 that drives a propeller 174 located in a chamber 172 at the rear of seat portion 144. The propeller 174 draws water into the chamber 172 through a pair of inlet passages 176 on opposite sides of the seat portion 144. The motor 170 and propeller 174 are angled upward toward the rear of the vessel 140 and propel water from the chamber 172 through an opening 179 in the rear of the seat portion 142.

A rudder 181 is located between the propeller 174 and the opening 179 and pivots from side to side in response to the user turning the steering member 147 that is connected to the rudder by a mechanical linkage 183 or a cable. The pivoting of the rudder 181 horizontally directs the water flow from the propeller 174 through the opening 179 to produce left or right movement of the vessel 140. A flat diving plane 185 is mounted behind the rudder 181 in opening 179. The steering member 147 is connected by another mechanical linkage 188 or cable to the diving plane 185 which pivots about a horizontal axis in response to moving steering member 147 in and out with respect to skirt 156. The pivoting of the diving plane 185 deflects the flow of water from the propeller 174 to control the vertical movement of the vessel.

Figure 13:
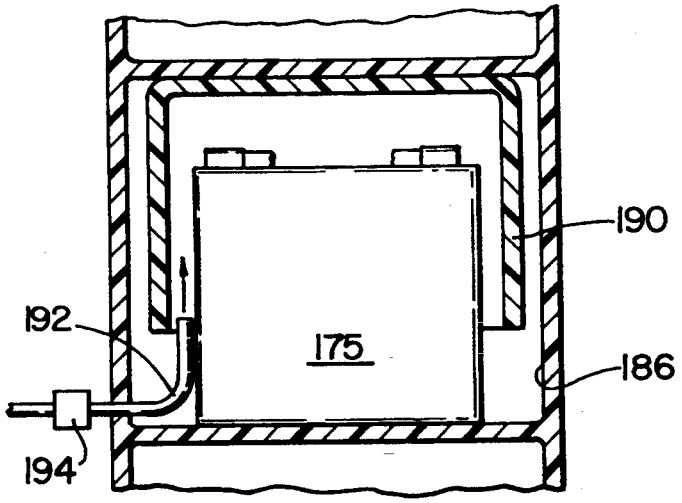
FIG. 13 is a cross section view of the battery cavity in FIG. 11.

The motor 170 can be powered by a gel-cell type battery 175 located within a forward cavity 186 in the seat portion 144 and accessible through a opening 189 in the front of the vessel 140 as shown in FIG. 13. A tube 192 can carry air from the tank 148 into the cover 190 over the battery and a flow restrictor 194 allows a small amount of air to pass through the tube into the cover. The air from the tube 192 fills the battery cover 190 with air, displacing any water that enters under the cover. Controls 173 on the steering member 147 turn on and off the electric motor 170 and control the speed of that motor.

Another cavity 196 in the upper region of the seat portion 142 houses a plurality of metal ballast plates 182 which counter the buoyancy of the vessel 140 when the helmet 152 is filled with air and thereby maintain the vessel upright. A removable seat cover 184 allows the ballast plates 182 to be removed from cavity 196 for easy transport of the vessel 140 out of the water.

I claim:

1. A submersible vessel comprising:

a seat portion extending substantially horizontally for receiving a rider astride the seat portion and permitting the legs of the rider to fully extend freely below said seat portion;

a body extending above and connected to said seat portion, and having a helmet that forms an interior compartment with an opening toward said seat portion so that at least a head of the rider can be received through the opening into the compartment, and at least a portion of the helmet being transparent, said body extending substantially vertically from a front end of said seat portion, wherein hands of the rider when seated on the seat portion can freely extend past said body and the entire submersible vessel in front of said seat portion, whereby the rider has access to the surrounding environment in front of the vessel; and a propulsion system operatively coupled to one of said seat portion and said body for propelling said submersible vessel underwater.

2. The submersible vessel as recited in claim 1, wherein said propulsion system comprises an electrically powered motor; and a propeller driven by said motor.

3. The submersible vessel as recited in claim 1, wherein said propulsion system comprises a motor; a propeller driven by said motor; and a moveable nozzle for directing a flow of water produced by said propeller.

4. The submersible vessel as recited in claim 1, wherein said propulsion system comprises a housing that is pivotally connected to said body; a motor mounted to said housing and a propeller driven by said motor.

5. A submersible vessel comprising:

a seat portion extending substantially horizontally for receiving a rider astride the seat portion and permitting the legs of the rider to fully extend freely below said seat portion;

a body extending above and connected to said seat portion, and having a helmet that forms an interior compartment with an opening toward said seat portion so that at least a head of the rider can be received through the opening into the compartment, and at least a portion of the helmet being transparent; and a propulsion system operatively coupled to one of said seat portion and said body for propelling said submersible vessel underwater, wherein said propulsion system comprises an electrically powered motor; and a propeller driven by said motor, further comprising a battery in said seat portion and connected to said motor; a cover extending over said battery; and a mechanism for filling the cover with air while the battery is submerged.

6. A submersible vessel comprising:

a seat portion extending substantially horizontally for receiving a rider astride the seat portion and permitting the legs of the rider to fully extend freely below said seat portion;

a body extending above and connected to said seat portion, and having a helmet that forms an interior compartment with an opening toward said seat portion so that at least a head of the rider can be received through the opening into the compartment, and at least a portion of the helmet being transparent; and a propulsion system operatively coupled to one of said seat portion and said body for propelling said submersible vessel underwater, wherein said propulsion system comprises a housing that is pivotally connected to and extends behind said body, and has a handle extending from the housing to in front of said body.

7. A submersible vessel comprising:

a seat portion extending substantially horizontally for receiving a rider astride the seat portion and permitting the legs of the rider to fully extend freely below said seat portion;

a body extending above and connected to said seat portion, and having a helmet that forms an interior compartment with an opening toward said seat portion so that at least a head of the rider can be received through the opening into the compartment, and at least a portion of the helmet being transparent; and a propulsion system operatively coupled to one of said seat portion and said body for propelling said submersible vessel underwater, wherein said propulsion system has a housing that is pivotally coupled to said seat portion; a motor mounted to said housing and a propeller driven by said motor.

8. A submersible vessel comprising:

a seat portion extending substantially horizontally for receiving a rider astride the seat portion and permitting the legs of the rider to fully extend freely below said seat portion;

a body extending above and connected to said seat portion, and having a helmet that forms an interior compartment with an opening toward said seat portion so that at least a head of the rider can be received through the opening into the compartment, and at least a portion of the helmet being transparent; and a propulsion system operatively coupled to one of said seat portion and said body for propelling said submersible vessel underwater, wherein said propulsion system is incorporated into said seat portion and comprises a motor and a propeller driven by said motor; and wherein said seat portion comprises a chamber within which said propeller is located, an inlet through which water enters the chamber and an outlet through which said propeller expels water from the chamber.

9. The submersible vessel as recited in claim 8, wherein the inlet is formed by openings in sides of the seat portion which openings communicate with the chamber.

10. The submersible vessel recited in claim 8, wherein said propulsion system further comprises a rudder pivotally mounted in the outlet to direct water flowing from the propeller.

11. The submersible vessel as recited in claim 10, further comprising a steering wheel mounted to one of said seat portion and said body, and operatively coupled to produce movement of said rudder.

12. The submersible vessel as recited in claim 10, wherein said propulsion system further comprises a diving plane pivotally mounted in the outlet to direct water flowing from the propeller thereby producing up and down movement of said submersible vessel.

13. The submersible vessel as recited in claim 12, further comprising a steering wheel mounted to one of said seat portion or said body, and operatively coupled to produce movement of said rudder and said diving plane in response to operation of said steering wheel by a user.

14. A submersible vessel comprising:

a seat portion for receiving a rider astride the seat portion, and having a forward section and a rear section and permitting the legs of the rider to fully extend fully below said seat position;

a pedestal extending from the forward section of said seat portion, said pedestal extending substantially vertically from the forward section of said seat portion, wherein hands of the rider when seated on the seat portion can freely extend past said pedestal and the entire submersible vessel in front of said seat portion;

a helmet attached to said pedestal remote from said seat portion and forming an interior compartment with an opening toward said seat portion wherein at least a head of the rider can be received through the opening into the compartment, and at least a portion of said helmet being transparent; and an air supply including a tank for containing compressed air and a conduit connecting the tank to the compartment of said helmet.

15. The submersible vessel as recited in claim 14, further including a ballast weight within said seat portion and removable therefrom to facilitate carrying said submersible vessel on land.

16. The submersible vessel as recited in claim 14, wherein said seat portion has a cavity containing ballast weight, and removable seat cover extending over an opening to the cavity.

17. The submersible vessel as recited in claim 14, wherein said pedestal has an elongated concave surface, and has a mechanism for fastening the tank against the concave surface.

18. The submersible vessel as recited in claim 14, wherein said helmet comprises a skirt attached to said pedestal; and a dome connected to said skirt, and having a rear portion with an opening and a transparent window sealed over the opening in said rear portion.

19. The submersible vessel as recited in claim 14, further comprising a motorized propulsion system operatively coupled to one of said seat portion and said helmet for propelling said submersible vessel underwater.

20. The submersible vessel as recited in claim 19, wherein said propulsion system comprises an electrically powered motor; and a propeller driven by said motor.

21. The submersible vessel as recited in claim 20 wherein said seat portion includes a pair of foot rests located on opposite sides of the forward section.

22. The submersible vessel as recited in claim 20 wherein said tank is housed within said seat portion of said body.

23. The submersible vessel as recited in claim 19, wherein said motorized propulsion system comprises a motor and a propeller within said seat portion.

* * * * *